US006170178B1

(12) United States Patent
Christy

(10) Patent No.: US 6,170,178 B1
(45) Date of Patent: Jan. 9, 2001

(54) POWERED QUICK ATTACH SNOWPLOW

(75) Inventor: Jody Christy, Iron Mountain, MI (US)

(73) Assignee: M.J. Electric, Inc., Iron Mountain, MI (US)

( * ) Notice: Under 35 U.S.C. 154(b), the term of this patent shall be extended for 0 days.

(21) Appl. No.: 09/320,669

(22) Filed: May 27, 1999

Related U.S. Application Data

(60) Provisional application No. 60/087,071, filed on May 28, 1998.

(51) Int. Cl.[7] ..... E01H 5/04

(52) U.S. Cl. ..... 37/231; 172/272

(58) Field of Search ..... 37/231, 232, 234, 37/235, 236, 240; 172/684.5, 439, 445.1, 450, 272, 810; 414/723, 724, 694, 697

(56) References Cited

U.S. PATENT DOCUMENTS

| | | | | |
|---|---|---|---|---|
| 5,014,452 | * | 5/1991 | Berghefer | 172/272 |
| 5,111,603 | * | 5/1992 | Knowlton et al. | 37/231 |
| 5,403,144 | * | 4/1995 | Staben, Jr. | 414/697 |
| 5,419,673 | * | 5/1995 | Merhar | 172/272 X |
| 5,581,917 | * | 12/1996 | Barden | 172/272 X |
| 5,590,483 | * | 1/1997 | Kim | 172/272 X |
| 5,642,785 | * | 7/1997 | Dam-Rasmussen | 172/272 |
| 5,692,855 | * | 12/1997 | Burton | 172/272 X |
| 5,778,567 | * | 7/1998 | Jager et al. | 172/272 X |

* cited by examiner

*Primary Examiner*—Robert E. Pezzuto
(74) *Attorney, Agent, or Firm*—Jim Zegeer

(57) ABSTRACT

The present invention provides a powered attachment system for coupling a plow or other implement to a vehicle. A plow lift cylinder extends to push the coupler up into position, aligning spring-loaded upper pins. Further, the spring-loaded pins automatically engage when the coupler holes are aligned with those of the push beam.

2 Claims, 6 Drawing Sheets

POWERED QUICK ATTACH SNOWPLOW

REFERENCE TO RELATED APPLICATION

This invention is the subject of provisional application Ser. No. 60/087,071 filed May 28, 1998 and entitled POWERED QUICK ATTACH SNOW PLOW.

BACKGROUND AND BRIEF DESCRIPTION OF THE INVENTION

The present invention provides a powered attachment system for coupling a snowplow or other implement to a vehicle. A lift cylinder extends to push the coupler up into position, aligning spring-loaded upper pins. Further, the spring-loaded pins automatically engage when the coupler holes are aligned with those of the push beam.

The preferred embodiment uses a hydraulic cylinder to move the coupler into position. However, a spring mechanism could alternatively be used. There are also alternative means of automatically engaging the upper pins (e.g. hydraulically, springs, mechanically).

An object of the invention is to provide a quick attachment system using two hitch points where:

(a) the first hitch connection containing a guide to align and connect the implement hitch point to the corresponding hitch point on the receiver, (b) a second hitch connection where the implement hitch point and the corresponding receiver hitch point are aligned by means of rotational, translational, or a combination motion of the implement and by the connection of the first hitch point.

Preferably, a hydraulic cylinder provides motion to the implement to align the second hitch point. Alternatively, a spring means could provide motion to the implement to align the second hitch point. Any of various means can automatically couple the hitch point when aligned including spring-loaded pins, and latches.

In a specific, preferred embodiment, a snowplow attachment system for quickly attaching a snowplow and snowplow frame to a vehicle is disclosed. The system includes a vehicle mounted frame attachment which is essentially permanently secured to the vehicle frame. The vehicle mounted frame has a pair of lug plates joined by a transverse push beam or frame member, each push pin receiver lug plate has an arcuate hook slot and a latch pin aperture. The snowplow frame having a subframe and a vertically extending lift/light tower pivotally connected at its lower end by a horizontal pivot to the trailing end of the subframe. A hydraulic piston and cylinder assembly is pivotally connected at its ends to (1) an upper end of the vertically extending lift/lift tower and (2) a point on the subframe spaced forwardly of the horizontal pivot. A hydraulic pump on one of the subframes and vertically extending lift/light tower and connected to the hydraulic piston and cylinder. An electrical motor drives the hydraulic pump. A transverse attachment bar engages the arcuate slot and is guided to the hook portion of the arcuate slot, and a spring-bias latch pin member is released to engage the latch pin apertures, respectively. An electrical switch on the vertically extending lift tower engages the hydraulic pump motor and operates the hydraulic piston and cylinder to rotate the vertically extending lift/light tower about the horizontal pivot and cause the transverse attachment bar to enter the hook slot of the pair of lug plates, and a pair of trip mechanisms for actuating the spring-bias latch pins to cause the latch points to enter said latch pin apertures when the transverse attachment bar has engaged the hook portion of the slot.

Reference is made to Capra et al, U.S. Pat. No. 5,568,694 (incorporated herein by reference) for a full exposition of the plow and its operation.

DESCRIPTION OF THE DRAWINGS

The above and other objects, advantage and features of the invention will become more clear when considered with the following specification and accompanying drawings wherein.

DETAILED DESCRIPTION OF THE INVENTION

Figure 1:
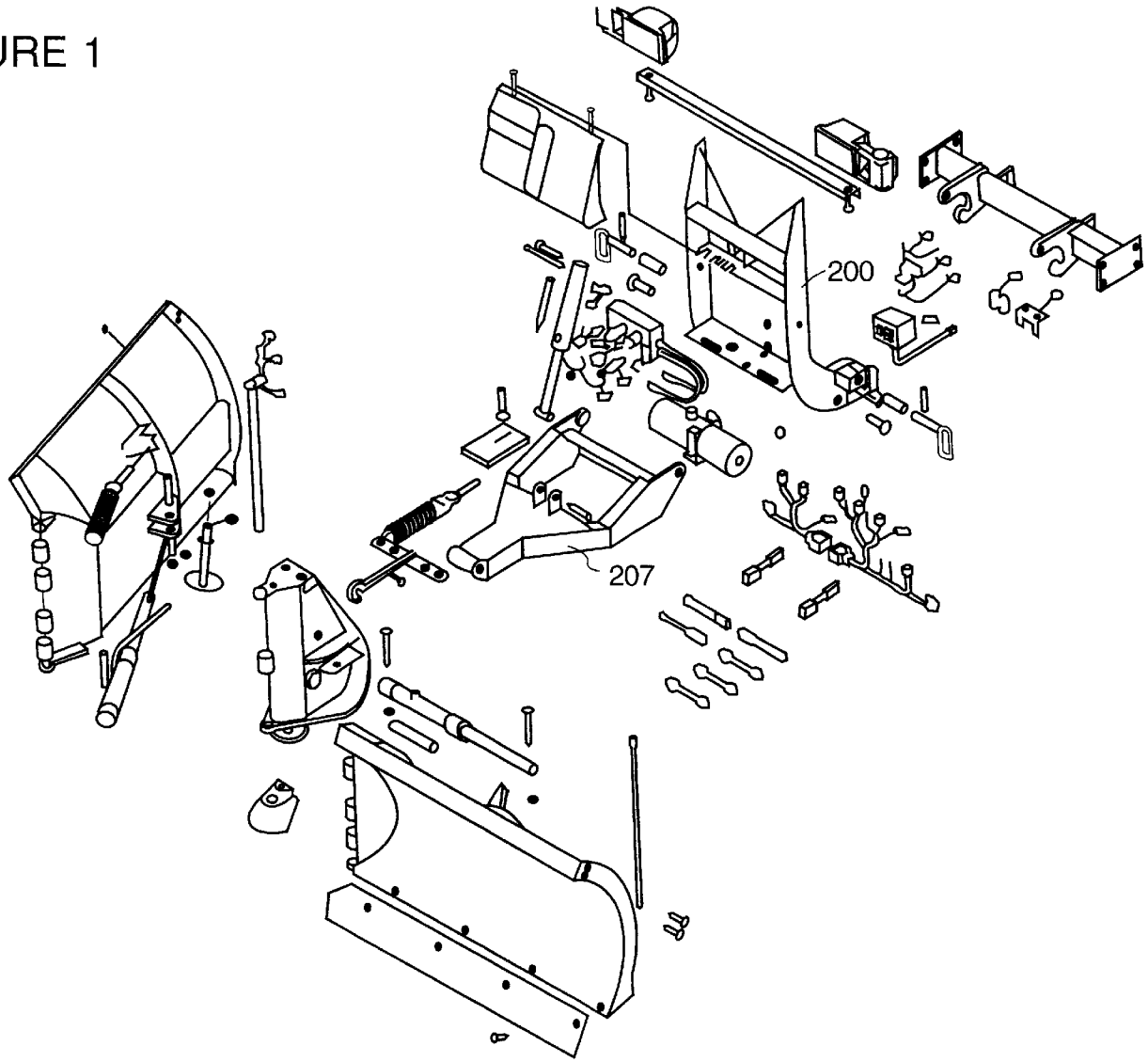
FIG. 1 is an exploded view of a snow plow system incorporating the invention.

Referring to FIG. 1, the following list sets out the component part number and description of the component part:

| Component Part | | Description |
|---|---|---|
| 1 | | Blade Half Right |
| 2 | | Blade Half Left |
| 3 | | Center Section, RT3 V-Blade (all models) |
| 4 | | T-Frame, RT3 V-Blade (all models) |
| 5 | | Cutting Edge, 7'6" V-Blade ⅝" Holes |
| 5 | | Cutting Edge, 8'2" V-Blade ⅝" Holes |
| 5 | | Cutting Edge, 9'2" V-Blade ⅝" Holes |
| 6 | | Carriage Bolt Set |
| | | Includes: |
| | | (10) Carriage Bolts ⅝" - 11 × 2" Grade #5 ZN |
| | | (10) ⅝" Hardened Washers |
| | | (10) ⅝" Lock Nuts |
| 7 | | Bumper Stop, w/Mounting Hardware |
| 7 | | A Self-Tapping Bolt, ⅜" - 16 × 2" Hex Washer Head ZN |
| 9 | | Spring Yoke, RT3 V-Blade |
| 10-44-45 | | Plow Shoe Assembly |
| | | Includes: |
| | | (1) Plow Shoe (1" Shaft) |
| | | (1) 7/16" Quick Pln |
| | | (20) 1" Flat Washers |
| 10-44-45 | | Plow Shoe, Cast Iron (Center Shoe) |
| | 5 | Includes: |
| | | (1) Plow Shoe (1" Shaft), Cast Iron |
| | | (1) 7/16" Quick Pin |
| | | (20) 1" Flat Washers |
| 11 | | Snow Catcher w/Mounting Hardware |
| 12 | | Horizontal Hinge Pin Kit, RT3 V-Blade (all models) |
| 13 | | Center Hinge Pin, RT3 V-Blade (all models) |
| 14 | | Hydraulic Pump - Power Unit Barnes |
| 14 | A | Hydraulic Pump Filler Cap |
| 14 | B | Hydraulic Pump Motor - Barnes |
| 14 | C | Hydraulic Pump Solenoid |
| 14 | D | Hydraulic Pump Solenoid Ground Cable |
| 14 | E | Battery cable, 66" |
| 14 | H | Ground/Power Cable 60" (Vehicle Side) |
| 14 | J | Ground/Power Cable 36" (Plow Side) |
| 14 | K | Ground/Power Cable Dust Cap/Plug |
| 14 | L | Hydraulic Reservoir Drain plug |
| 15 | | Hydraulic Valve Assembly with SmartHitch |
| 15 | A | Hydraulic Lift/Angle Valve |

-continued

| Component Part | | Description |
|---|---|---|
| 15 | B | Hydraulic Valve Coil |
| 15 | C | Hydraulic Relief Valve |
| 15 | D | Hydraulic Check Valve |
| 15 | E | Hydraulic Valve Screen Cartridge |
| 15 | F | Hydraulic Valve Ground Strap |
| 15 | G | Hydraulic Valve, SmartHitch Attach |
| 15 | H | Hydraulic Valve, Flow Control Cartridge |
| 16 | | SmartHitch Toggle Switch Kit (Includes Switch and Jumpers) |
| 17 | | Hydraulic Cylinder, Angle |
| 18 | A | Hydraulic Hose ¼" × 12" , ¼" MNPT × ¼" MNPT) |
| 18 | B | Hydraulic Hose ¼" × 15½" ,(¼" MNPT × ¼" MNPT) |
| 18 | C | Hydraulic Hose ¼" × 15" (¼" ORB × ¼" MNPT |
| 22 | | Hydraulic Hose ⅜" × 40" (¼" MNPT × ⅜" MNPT) |
| 25 | | Hydraulic Cylinder, RT3 Lift |
| 32 | | Hydraulic Swivel Fitting, 90 Deg. (¼" ORS × ¼" FPS) |
| 33 | | Trip/Return Spring |
| 37 | | Blade Guide Set |
| 37 | A | Blade Guide Tip |
| 38 | | Auxiliary Headlight Set, Low Profile Plastic |
| 38 | A | Turn Signal Cover, Low Profile Plastic |
| 38 | L | Auxiliary Headlight, Left, Low Profile Plastic |
| 38 | R | Auxiliary Headlight, Right, Low Profile Plastic |
| 39 | | Auxiliary Light Harness Assembly<br>Includes:<br>Toggle Switch<br>Connectors |
| 39 | A | Light and Control Harness 116" (Vehicle Side) |
| 39 | B | Light and Control Harness 48" (Plow Side) |
| 40 | A | Switch Box Control, V-Blade |
| 40 | B | Joystick Control, V-Blade |
| 41 | | Rocker Switch - Lift |
| 42 | | Rocker Switch - Angle |
| 44 | | Quick Pin - 7/16" |
| 46 | | Hydraulic Fitting, 90 Deg. (⅛" MNPT × ¼" FNPT) |
| 47 | | Eye Bolt, ½" |
| 55 | | Hex Head Cap Screw, ⅝" - 11 × 4½" GR5 ZN |
| 60 | | Pivot Pin, Kit (Includes Cotter Pins and Washers) |
| 60 | A | Pivot Pin |
| 60 | B | 3/16" Cotter Pin |
| 61 | | Coupler Assembly |
| 62 | | Push Beam Assembly, RT 3 |
| 62 | A | Push Beam Support Plat RH (Passenger Side) |
| 62 | B | Push Beam Support Plate LH (Driver Side) |
| 64 | | Coupler Spring Pin Kit<br>Includes:<br>Coupler Spring Pin<br>Rolled Pin<br>Coupler Spring Pin Spring |
| 64 | A | Coupler Spring Pin |
| 64 | B | Rolled Pin (5/16" × 26½" ) |
| 64 | C | Coupler Spring Pin Spring |
| 67 | | Spring, SmartHitch Torsion Spring |
| 71 | | Washer, ⅜" Split Lock |
| 72 | | Washer, ⅜" Fender |
| 73 | | Light Bracket Assembly |
| 73 | A | Hydraulic Enclosure Cover |
| 73 | B | Rubber Grommet |
| 73 | C | Thumb Screw, 10 - 24 × ½" |
| 75 | A | Angle Bracket RH (Passenger Side) |
| 75 | B | Angle Bracket LH (Driver Side) |
| 80 | | Control Harness Mounting Bracket |
| 85 | | Hairpin Cotter, #16 |
| 86 | | Clevis Pin, ⅝" × 3½" |
| 96 | | Hex Head Cap Screw, ⅝" - 11 × 5½" GRS ZN |
| 97 | | Nut, Self-Locking ⅝" - 11 ZN |
| 101 | | Power Ground Cable Mounting Bracket |
| 102 | | Rubber Split Grommet, 1⅛" |
| 104 | | Weather Cap for Light & Control Harness (Vehicle Side) |
| 106 | | Weather Cap for Light & Control Harness (Plow Side) |
| 108 | | Headlight Adapter Kit |

Figure 2A:
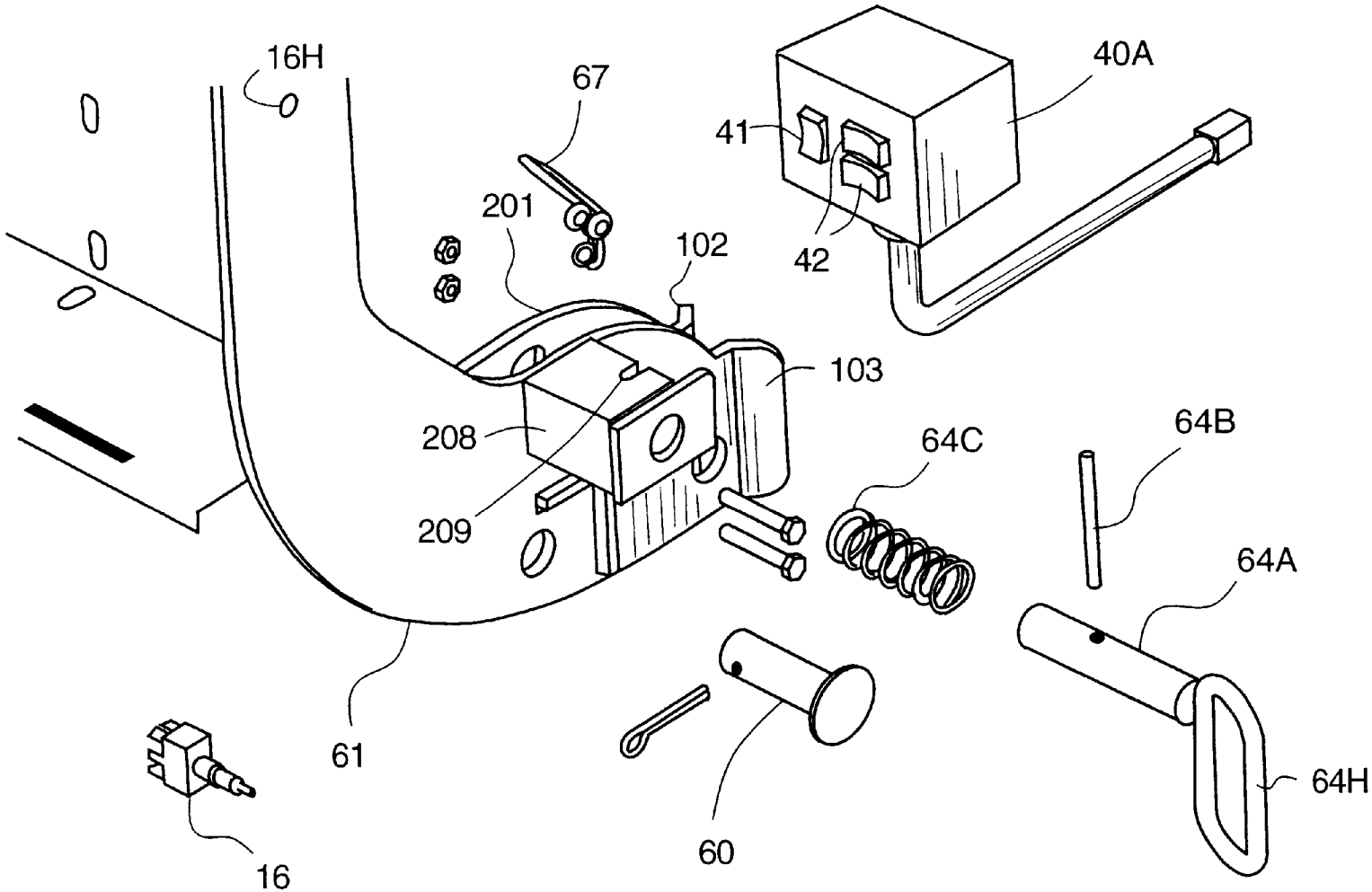
FIG. 2A is an enlarged view of the section of FIG. 1 containing the toggle switch and latching mechanism.
Figure 2B:
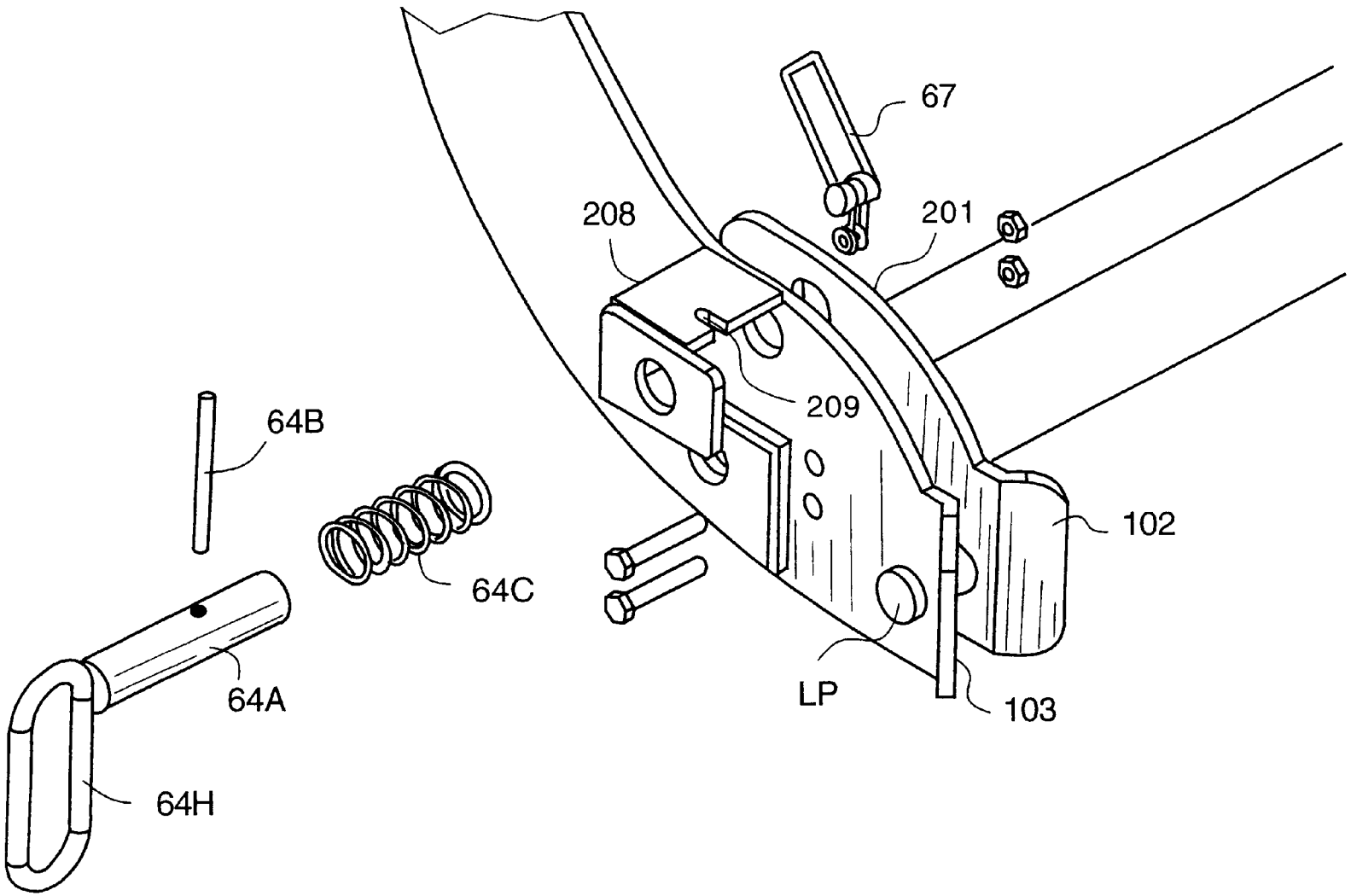
FIG. 2B is an enlarged view of the latching mechanism from a different perspective.
Figure 4:
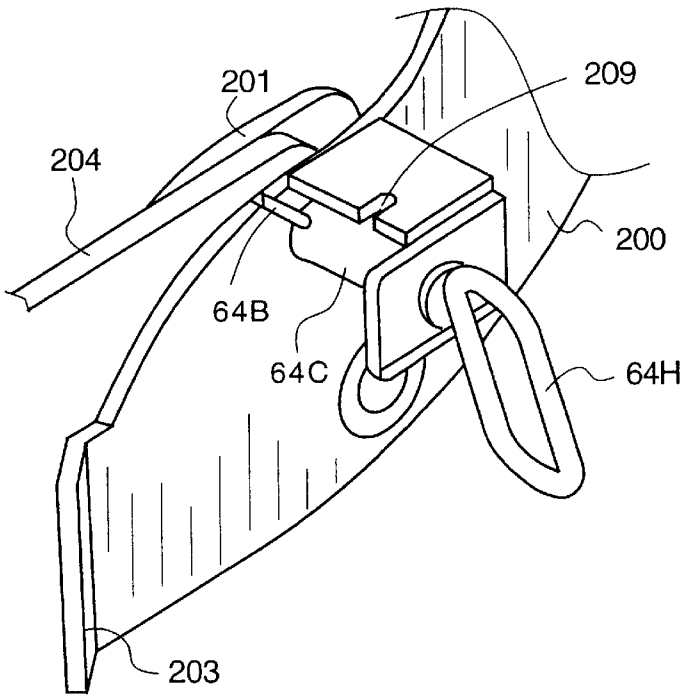
FIG. 4 shows the coupler spring pin in a latched position.
Figure 3:
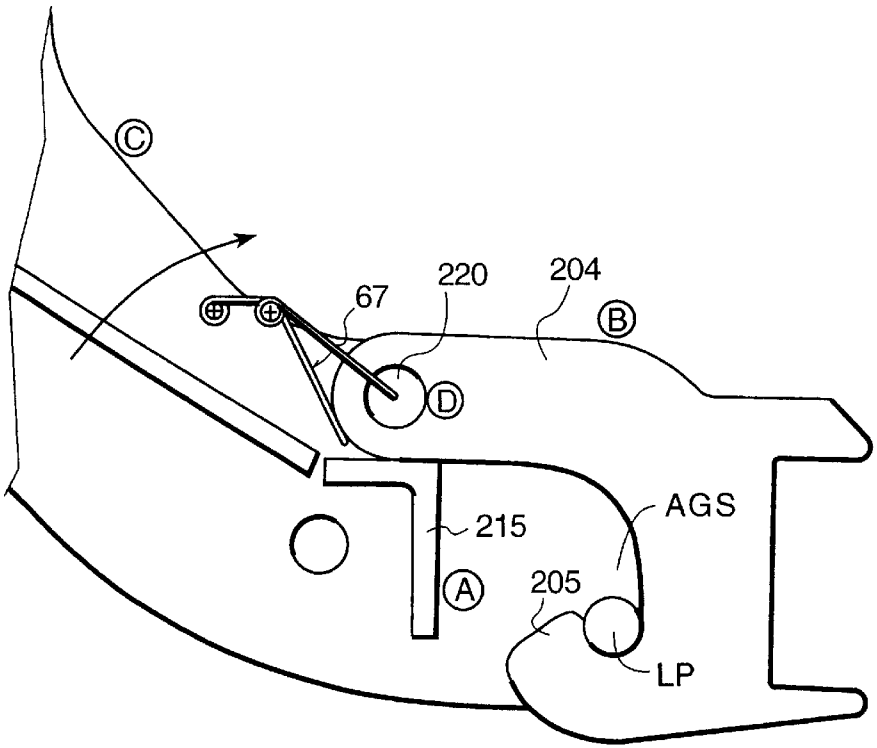
FIG. 3 is an enlarged view of a modification.

Referring now to FIGS. 2, 3 and 4, the lower end of L-shaped light tower upright member 200 (only one side described) has a side plate 201 fixedly spaced therefrom to define a latching slot with diverging guide ends 202, 203, which guides the push beam pin receiver 204 and latch hook 204 into the slot 206 formed thereby. The L-shaped tower upright member 200 is pivoted on the end of plow frame assembly 207 by pivot pin 60 and this pivotal movement is driven by hydraulic lift cylinder 25 (FIG. 1) in a manner to be described later in connection with FIGS. 5A–6B. Coupler spring pin 64A has a cocking pin 64B and a coaxial coupler spring pin spring 64C for loading and biasing the coupler spring pin 64A to latching position. Coupler spring pin mounting bracket 208 has a notch 209 for releasably receiving end of cocking pin 64B. A toggle switch 16 is mounted in hole 16H and connected in circuit with the hydraulic lift rocker switch 41 in switch box 40A. (Rocker switches 42 control the operation of the plow blades 1 and 2 (FIG. 1)). Torsion spring 67 is mounted in latching slot 206 so that it blocks the holes in the lower end of L-shaped member 200 with which coupler spring pin 64A is axially aligned to thereby block the coupler spring pin spring 64C from moving the end of coupling spring pin 64A through hole 220 push beam pin receiver 204 when in alignment as shown in FIG. 4. Spring 64C is compressed between the outside wall of housing 208 and pin 64B in the locked position.

Figure 5B:
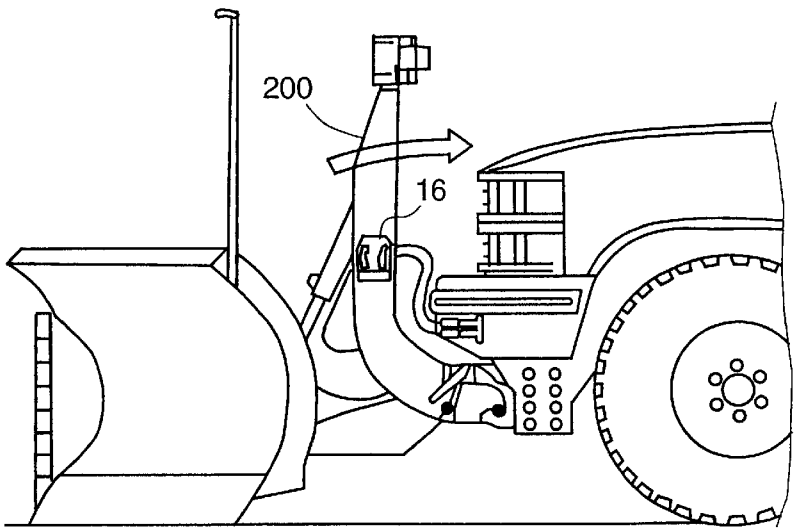
FIGS. 5A and 5B illustrate the mounting of a snowplow to a vehicle according to the invention.
Figure 5A:
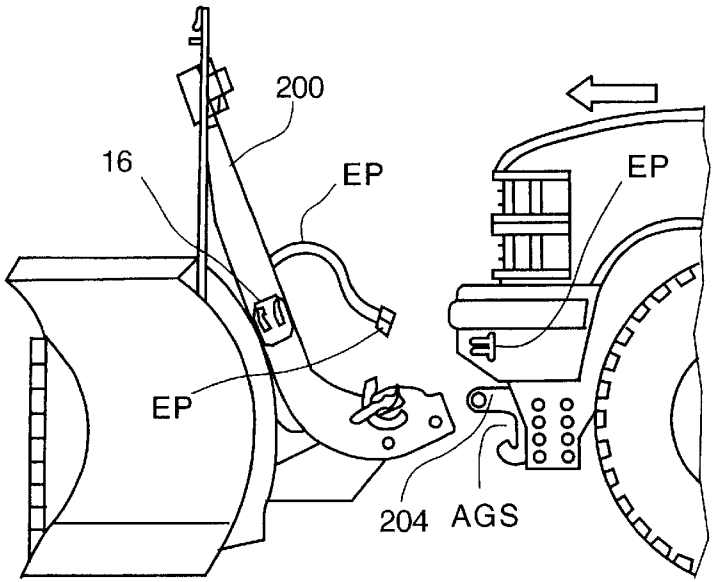
Figure 6B:
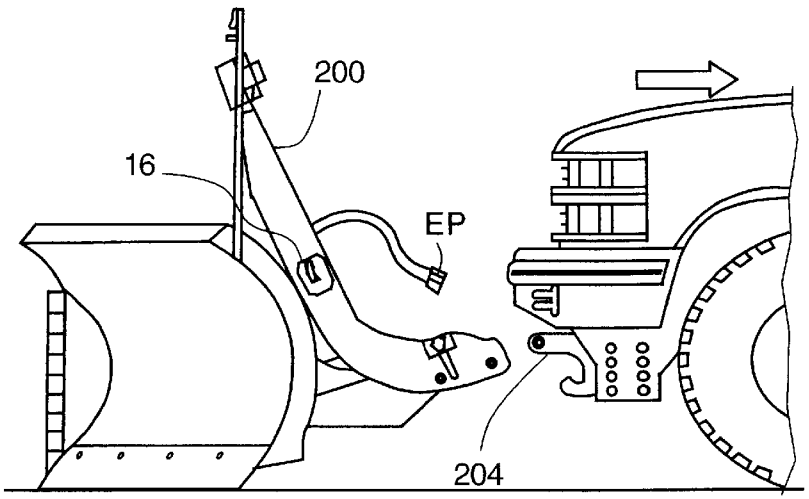
FIGS. 6A and 6B illustrate the removal of a snowplow from a vehicle according to the invention.
Figure 6A:
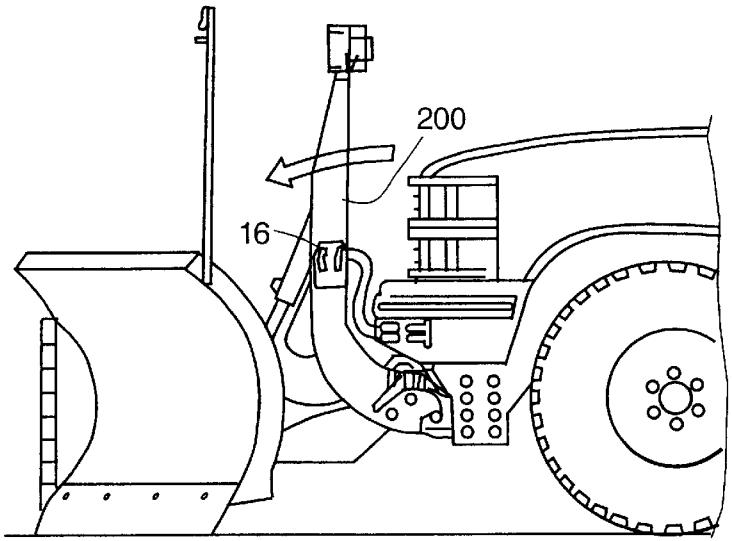

The mounting and removal of a snow plow on a vehicle equipped with the push beam assembly 62 is illustrated in FIGS. 5A–6B. Referring to FIG. 5A, the vehicle is lined up with the snowplow and the vehicle driven straight in until the lower pin LP contacts the arcuate lower pin LP guide slot AGS in the push beam pin receiver 204 and latch hook 205. The electrical plugs EP are connected to the complementary electrical plug on the vehicle. This connects plow controls switches 40A to the hydraulic control system and toggle switch 16, when actuated, to control the operation of hydraulic lift cylinder 25. At this time, the spring pins 60A are turned by handle 64H ½ turn clockwise to disengage cocking pins 64B from notches 209 and allow the end of coupler spring pins 64A to bear on torsion spring 67 which is blocking the movement of the pin into latching position. Also, at this time, the toggle switch 16 is actuated. Then the raise button rocker switch 41 is pressed until the push beam spring receiver 204 engages torsion spring 67 and unblocks coupler spring pin 64A allowing them to snap into the latch hole LH in the push beam receiver 204 as shown in FIG. 5B. It will be appreciated that for safety both the left and right side coupler spring pins must be fully engaged to avoid personal injury and property damage. The toggle switch 16 is turned down to the raise plow position. To remove the snow plow from the vehicle, the plow is lowered with both wings or blades retracted to the Vee position and resting on the ground. Toggle switch 16 is moved to the top position and the raise button (42) control operated until the coupler tower 61 moves toward the vehicle and releases tension on the spring pins 64A. The handles 64H are used to pull the coupler spring pins outward and rotate to the open position into locking notches 209. The toggle switch 16 is moved to the down position. Then the raise button (switch 42) is actuated until the coupler tower 61 completely lowers the plow in the position shown in FIG. 6B, the electrical plugs are disconnected (and dust plugs installed). The vehicle is now free of the plow and can be backed away slowly.

Referring now to FIG. 3, an angle member 215 is positioned fixedly so that it limits rotation of coupler 61 toward the vehicle when it contacts the bottom of pin receiver 204 preventing possible overtravel and damage to the front of the vehicle. Angle member 215 also forces vertical alignment of latch hole 220 for the spring load pin in the event pin receiver 204 is too low compared to coupler 61 to improve the ease of attachment.

While the invention has been described in relation to preferred embodiments of the invention, it will be appreciated that other embodiments, adaptations and modifications of the invention will be apparent to those skilled in the art.

What is claimed is:

1. In a snowplow attachment system for quickly attaching a snowplow and snowplow frame to a vehicle, said system including a vehicle mounted frame attachment adapted to be secured to said vehicle, said vehicle mounted frame attachment having a pair of lug plates joined by a transverse frame member, each said lug plate having an arcuate hook slot and a latch pin aperture, said snowplow frame having a subframe having a trailing end and a vertically extending lift/light tower, said vertically extending lift/light tower having upper and lower ends pivotally connected at its lower end by a horizontal pivot to the trailing end of said subframe, a hydraulic piston and cylinder assembly having first and second ends, said pivotally connected at (1) the upper end of said vertically extending lift/light tower and (2) a point on said subframe spaced forwardly of said horizontal pivot, a hydraulic pump on one of said subframe and vertically extending lift/light tower and connected to said hydraulic piston and cylinder assembly, an electrical motor for driving said hydraulic pump, a transverse attachment bar for engaging said arcuate slot and being guided to the hook portion of said arcuate hook slot, and spring-bias latch pin members for engaging said latch pin apertures, respectively, the improvement comprising:

an electrical switch on said vertically extending lift tower for energizing said electrical motor and hydraulic pump and operate said hydraulic piston and cylinder assembly to thereby rotate said vertically extending lift/light tower about said horizontal pivot and cause said transverse attachment bar to enter each said hook slot of said pair of lug plates, and a trip mechanism for actuating each said spring-bias latch pin members, respectively, to cause said latch pin members to enter said latch pin apertures when said transverse attachment bar has engaged the hook portion of said slot.

2. The attachment system defined in claim 1 including a member to limit rotation of said lift/light tower toward the vehicle and force alignment of latch pins with said latch pin apertures.

* * * * *